US007416466B2

(12) United States Patent
Isawa

(10) Patent No.: US 7,416,466 B2
(45) Date of Patent: Aug. 26, 2008

(54) FLYING TOY

(75) Inventor: Kunikazu Isawa, Tokyo (JP)

(73) Assignee: Taiyo Kogyo Co., Ltd., Tokyo (JP)

( * ) Notice: Subject to any disclaimer, the term of this patent is extended or adjusted under 35 U.S.C. 154(b) by 349 days.

(21) Appl. No.: 11/222,352

(22) Filed: Sep. 7, 2005

(65) Prior Publication Data

US 2006/0121819 A1 Jun. 8, 2006

(30) Foreign Application Priority Data

Dec. 7, 2004 (JP) ..... 2004-353720

(51) Int. Cl.
*A63H 27/133* (2006.01)

(52) U.S. Cl. ..... 446/37

(58) Field of Classification Search ..... 446/36, 446/37

See application file for complete search history.

(56) References Cited

U.S. PATENT DOCUMENTS 2,256,918 A * 9/1941 Young ..... 416/43
2,638,707 A * 5/1953 Baker ..... 446/37
2,650,667 A * 9/1953 Young ..... 416/131
4,272,041 A * 6/1981 Mabuchi et al. ..... 244/17.21
5,071,383 A * 12/1991 Kinoshita ..... 446/37

FOREIGN PATENT DOCUMENTS

JP 3024905 3/1996
JP 3050648 5/1998

* cited by examiner

*Primary Examiner*—John Ricci
(74) *Attorney, Agent, or Firm*—Jordan and Hamburg LLP

(57) ABSTRACT

A flying toy is provided in which a flying object on a model having an optional character can be caused to freely ascend/descend or hover by remote control. The flying toy comprises: a flying object which replicates a model having a character; an upper rotor and a lower rotor which are provided on the top of the flying object and which concentrically rotate in directions opposite from each other; a stabilizer which rotates in conjunction with at least one of the rotors and which stabilizes a posture; a driver which is provided inside the flying object and which rotates the upper rotor, the lower rotor and the stabilizer; a control circuit for remote control to control an operation of the driver and a battery to serve as a power source which are provided inside the flying object.

3 Claims, 7 Drawing Sheets

FLYING TOY

BACKGROUND OF THE INVENTION

1. Field of the Invention

The present invention relates to a flying toy in which a flying object on a model having an optional character can be caused to freely ascend/descend and hover by remote control.

2. Description of the Related Art

There has heretofore been proposed a toy to play by flying a model such as a doll having an optional character in the air. For example, a flying toy has been proposed wherein a wing is attached to an upper part of a flying object comprising a character doll, turning force is manually applied to the flying object by a propeller, and the flying object is caused to ascend and fly by lift force produced in the wing using a principle of Taketonbo or a T-shaped flying toy made of bamboo (refer to Japanese Registered Utility Model Publication No. 3024905 (page 2, FIG. 1)). There has also been proposed a character flying toy wherein a propulsion shaft provided with a propeller projects from a character doll formed to have an optional appearance, the entirety is suspended by a line, and the propulsion shaft is actuated to achieve a circular flight (refer to Japanese Registered Utility Model Publication No. 3050648 (page 2, FIGS. 1 to 4)).

In conventional flying toys using the principle of the Taketonbo, the character doll itself is rotated, which results in motions quite different from those made by the character doll while flying in worlds of cartoons and stories for children where the character doll appears and plays an active role. Moreover, when the character doll is suspended by the line from a ceiling or the like to cause it to fly, the character doll only circles around a point at which it is suspended from the ceiling or the like, and it is thus impossible to play with the character doll by causing it to freely ascend/descend or to hover in the air to a certain degree. On the contrary, for example, when a single-rotor type helicopter device is incorporated into the character doll, it is necessary to attach a tail rotor to the character doll, which might impair external appearance.

SUMMARY OF THE INVENTION

The present invention has been attained in view of these circumstances, and it is an object thereof to provide a flying toy in which a flying object on a model having an optional character can be caused to freely ascend/descend and hover by remote control without rotating the flying object.

To achieve the foregoing object, in the invention according to claim 1, a flying toy comprises: a flying object which replicates a model having a character; an upper rotor and a lower rotor which are provided on the top of the flying object and which concentrically rotate in directions opposite from each other; a stabilizer which rotates in conjunction with at least one of the rotors and which stabilizes a posture; a driver which is provided inside the flying object and which rotates the upper rotor, the lower rotor and the stabilizer; and a control circuit for remote control to control an operation of the driver and a battery to serve as a power source which are provided inside the flying object. Thus, the flying object on the model having an optional character can freely ascend/descend and hover by remote control without rotating.

In the invention according to claim 2, the stabilizer and the upper rotor are attached so that surfaces of rotor blades of the upper rotor tilt in conjunction with the stabilizer via a link when the stabilizer tilts from a horizontal position. The stabilizer and the upper rotor are actuated in conjunction with each other, thereby making it possible to easily stabilize the posture.

In the invention according to claim 3, the flying object is formed on a model of a doll, and the upper rotor and the lower rotor are provided on a head or a rear side part of the flying object. It is possible to enjoy flying the flying object modeled on the doll.

A flying toy comprises: a flying object which replicates a model having a character; an upper rotor and a lower rotor which are provided on the top of the flying object and which concentrically rotate in directions opposite from each other; a stabilizer which rotates in conjunction with at least one of the rotors and which stabilizes a posture; a driver which is provided inside the flying object and which rotates the upper rotor, the lower rotor and the stabilizer; and a control circuit for remote control to control an operation of the driver and a battery to serve as a power source which are provided inside the flying object. Thus, the flying object on the model having an optional character can freely ascend/descend and hover by remote control without rotating.

DETAILED DESCRIPTION OF THE PREFERRED EMBODIMENT

Figure 1:
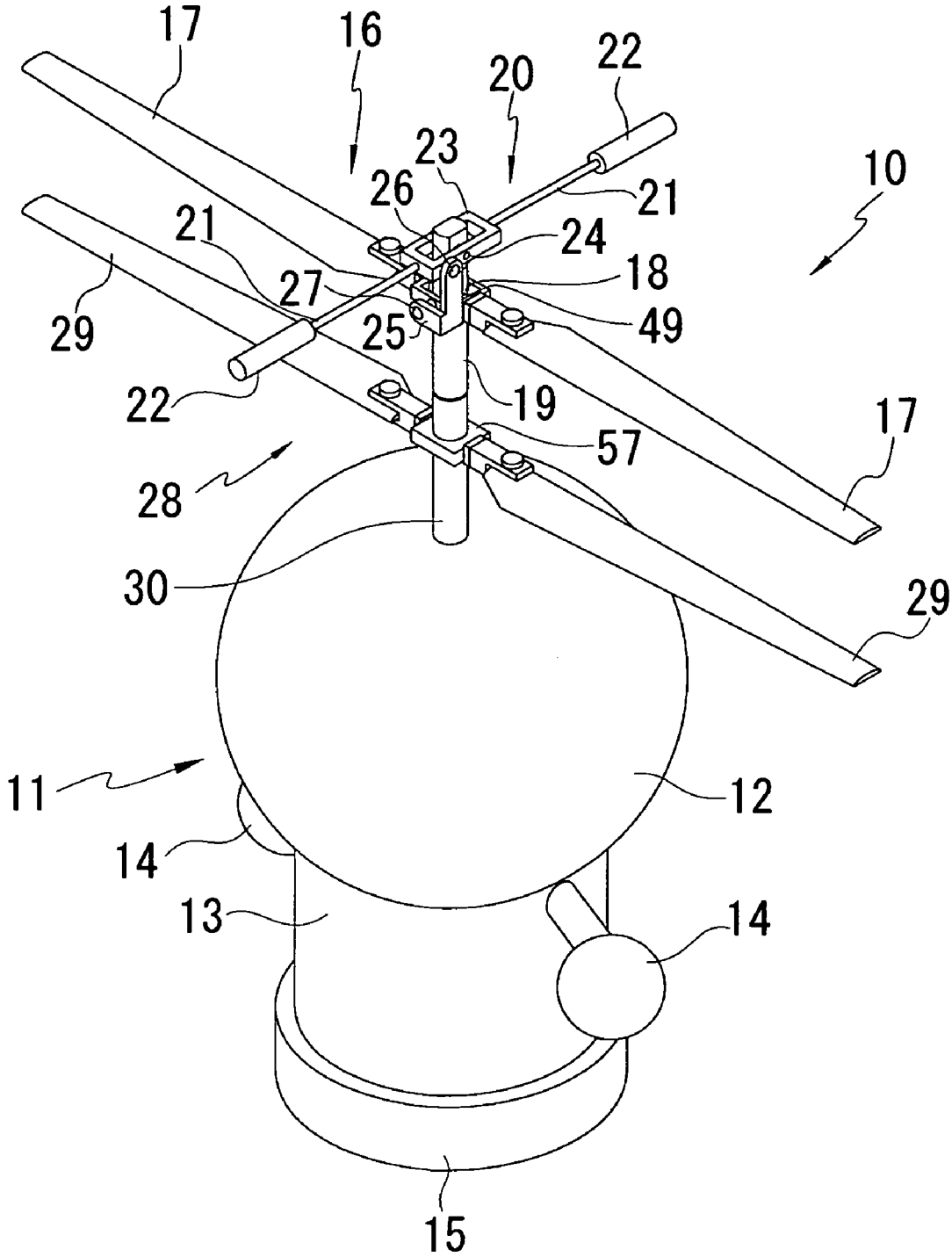
FIG. 1 is a perspective view of a flying toy in a first embodiment of the present invention.
Figure 2:
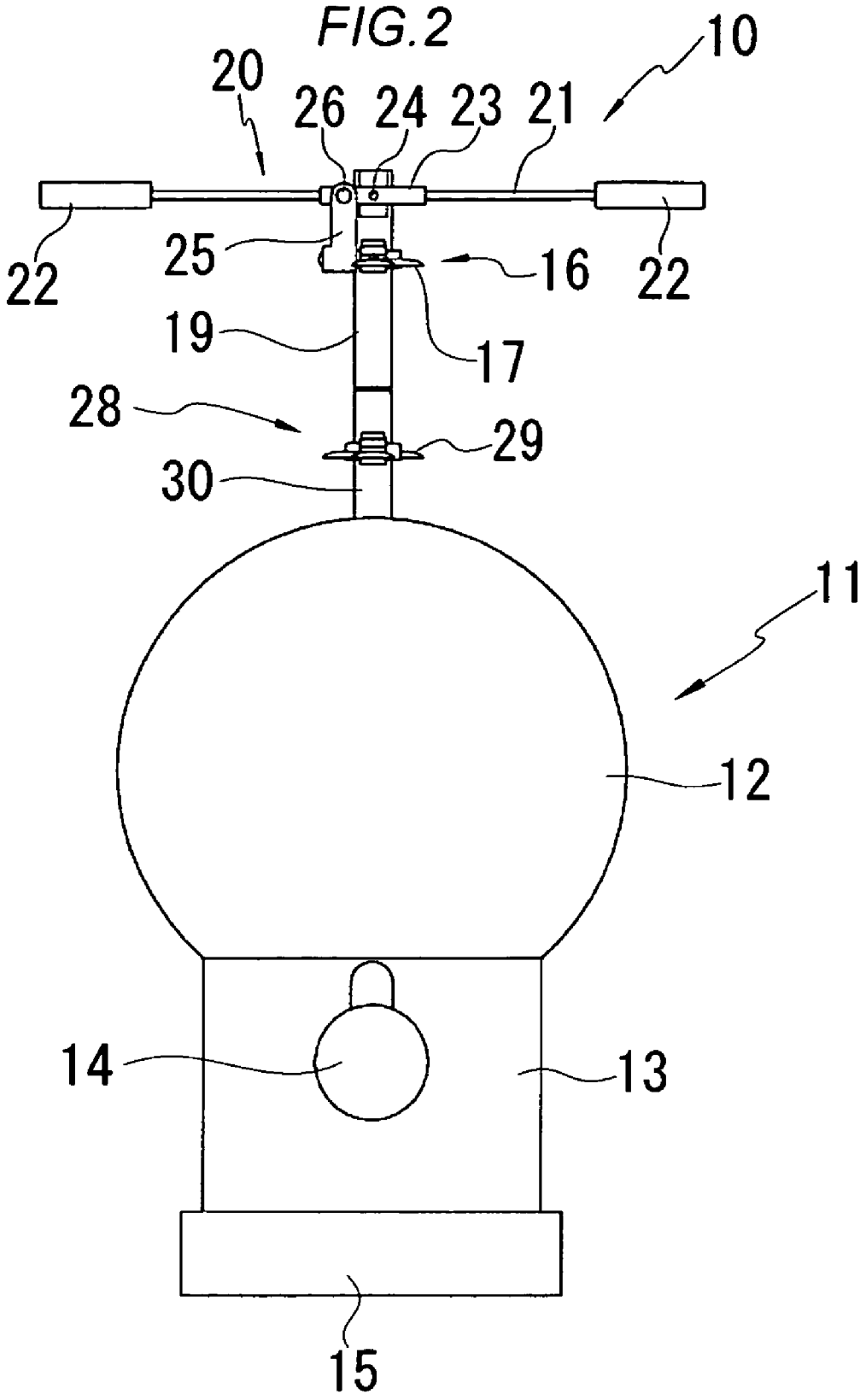
FIG. 2 is a side view of the flying toy in the first embodiment of the present invention.
Figure 3:
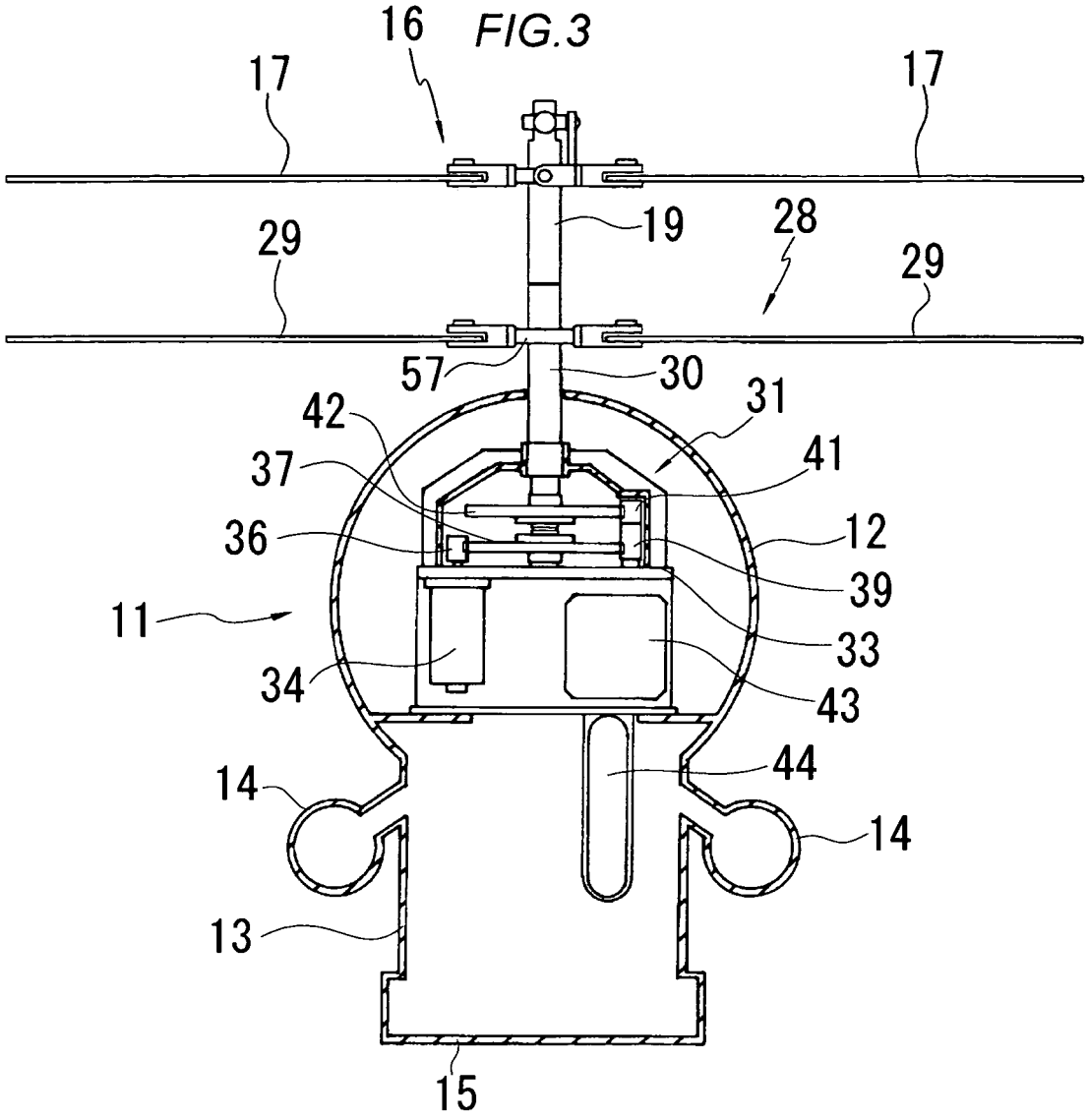
FIG. 3 is a sectional view of a flying object part of the flying toy in the first embodiment of the present invention.
Figure 4:
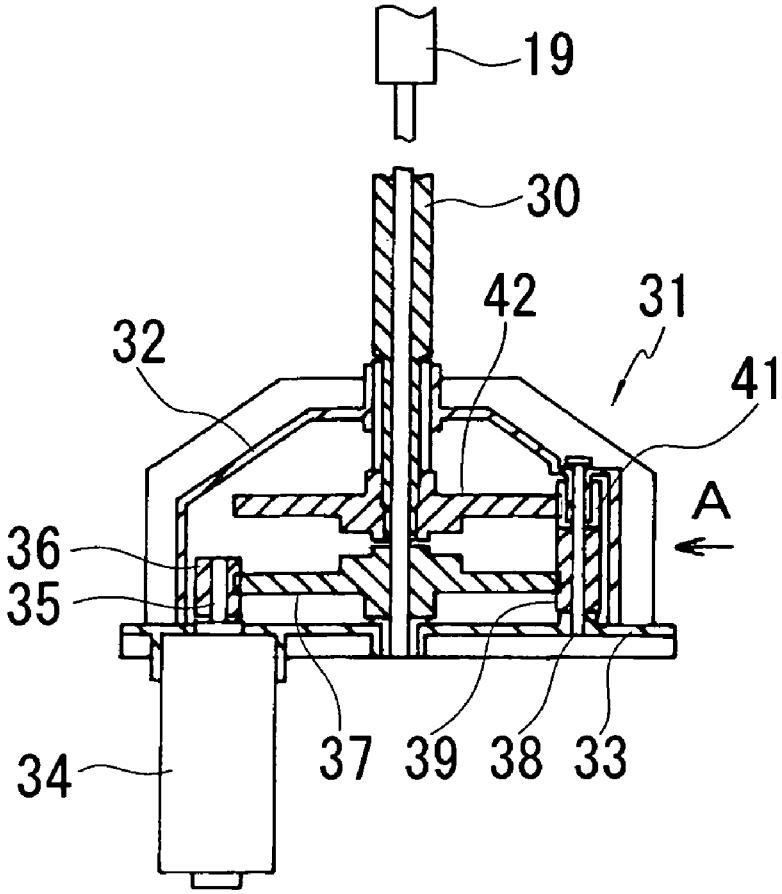
FIG. 4 is an enlarged sectional view showing a driver of the flying object in the first embodiment of the present invention.
Figure 5:
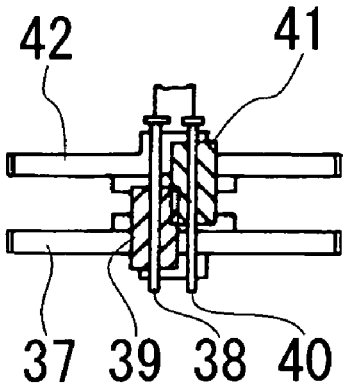
FIG. 5 is a view in an arrow A direction of a gear portion in FIG. 4 of the present invention.
Figure 6:
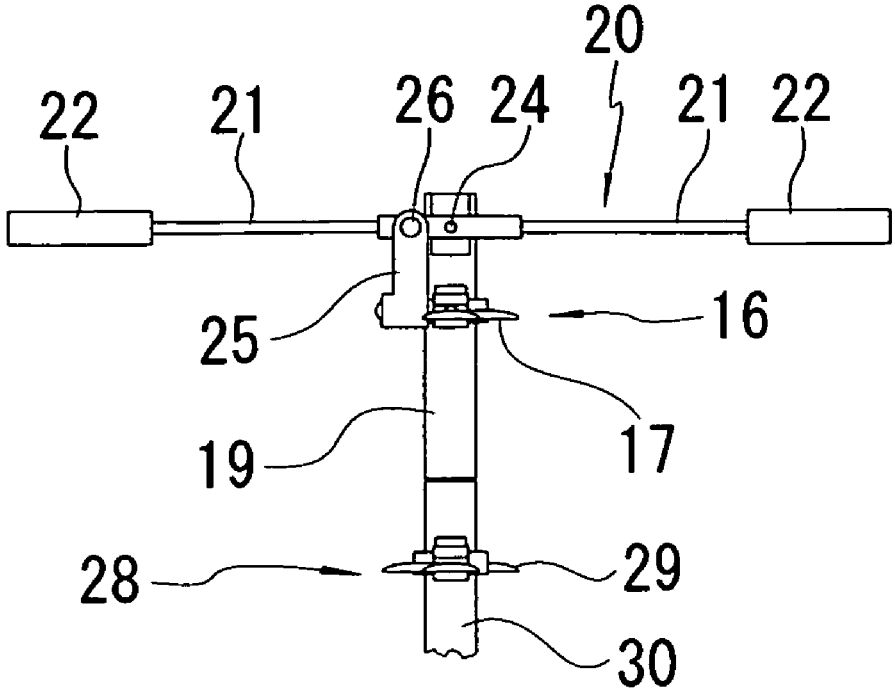
FIG. 6 is a diagram to explain an operation of a rotor portion in the first embodiment of the present invention.
Figure 7:
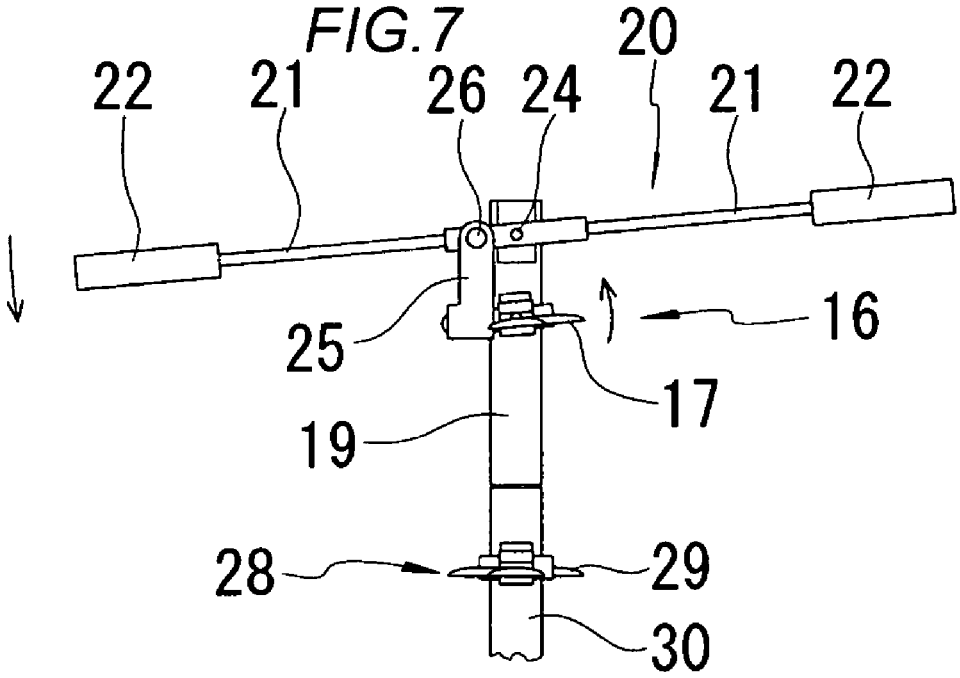
FIG. 7 is a diagram to explain the operation of the rotor portion in the first embodiment of the present invention.
Figure 8:
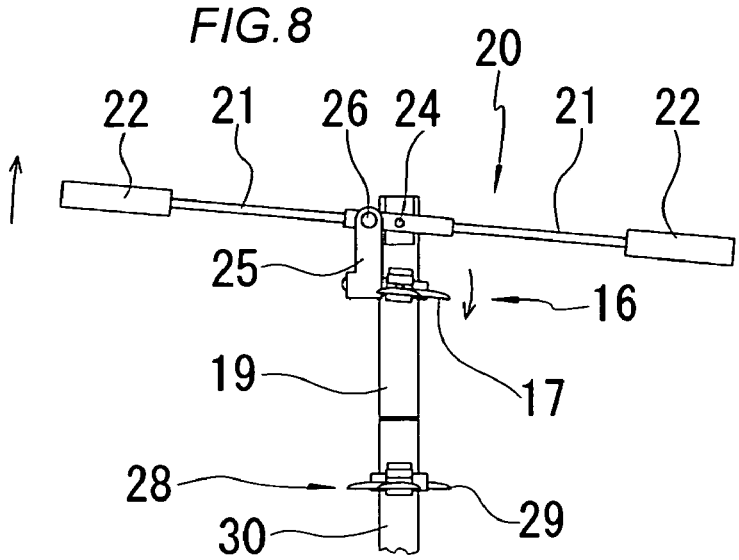
FIG. 8 is a diagram to explain the operation of the rotor portion in the first embodiment of the present invention.
Figure 9:
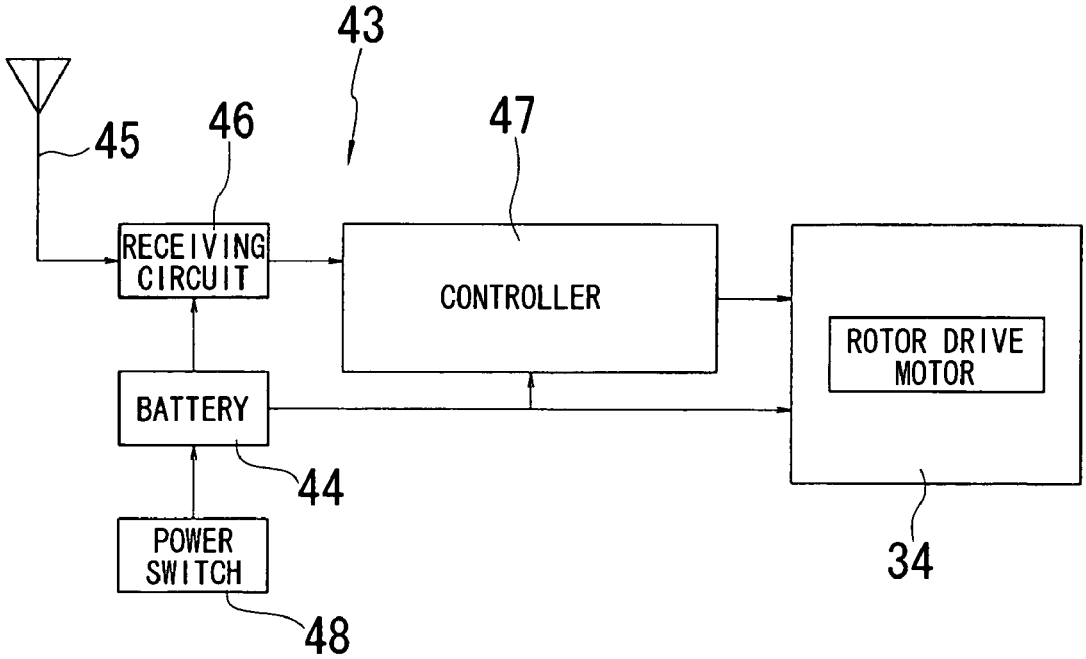
FIG. 9 is a block diagram to explain a control operation of the flying toy in the first embodiment of the present invention.

The present invention will hereinafter be specifically described with reference to one embodiment shown in the drawings. FIGS. 1 to 9 are diagrams to explain a flying toy in a first embodiment of the present invention. FIG. 1 is a perspective view of the flying toy; FIG. 2 is a side view of the flying toy; FIG. 3 is a sectional view of a flying object part of the flying toy; FIG. 4 is an enlarged sectional view showing a driver of the flying object; FIG. 5 is a view in an arrow A direction of a gear portion in FIG. 4; FIGS. 6 to 8 are diagrams to explain an operation of a rotor portion; and FIG. 9 is a block diagram to explain a control operation of the flying toy.

A flying toy 10 of the present embodiment comprises: a flying object 11 which replicates a model such as a doll having an optional character; an upper rotor 16 and a lower rotor 28 which are provided on the top of the flying object 11 and which concentrically rotate in directions opposite from each other; a stabilizer 20 which rotates in conjunction with one of the rotors and which stabilizes a posture; a driver 31 which is provided inside the flying object 11 and which rotates the upper rotor 16, the lower rotor 28 and the stabilizer 20; a control circuit 43 for remote control to control an operation of the driver 31 and a battery 44 to serve as a power source which are provided inside the flying object 11; etc. The flying toy 10 receives a signal from a predetermined transmitter to control the operation of the driver 31 by the control circuit 43 in order to rotate the upper rotor 16 and the lower rotor 28, thereby playing with the flying toy 10 by causing it to ascend/descend or hover in the air.

The flying object 11 is hollowly formed of a material such as a plastic on a model of, for example, a character doll having an optional shape. In this embodiment, the flying object 11 has a circularly formed head 12 on an upper side, a cylindrical body 13 formed on a lower side of the head 12, arms 14, 14 provided on right and left side surfaces of the body 13, and a foot 15 provided at the bottom of the body 13.

The upper rotor 16 has a rotor driving shaft 18 attached to penetrate an upper rotor rotation shaft 19 in a direction orthogonal to a rotation shaft center of the upper rotor rotation shaft 19, an upper blade holder 49 pivotally attached to both ends of the rotor driving shaft 18, and a pair of upper rotor blades 17, 17 attached on both end surface sides of the upper blade holder 49 along a shaft center direction of the rotor driving shaft 18, wherein rotation of the upper rotor rotation shaft 19 is transmitted to the pair of upper rotor blades 17, 17 via the rotor driving shaft 18 and the upper blade holder 49. The upper blade holder 49 is formed in a rectangular ring shape slightly larger than an outside diameter of the upper rotor rotation shaft 19, and pivotally attached to the rotor driving shaft 18 as described above. The upper blade holder 49 pivots to tilt surfaces of the upper rotor blades 17, 17. Further, a shaft-like joint 27 projects, in a direction orthogonal to a shaft center of the rotor driving shaft 18, on one end surface of the upper blade holder 49 where the upper rotor blades 17, 17 are not attached, and a link 25 to move in conjunction with the stabilizer 20 which will be described later in detail is attached to the joint 27.

The stabilizer 20 is attached on an upper side of the upper rotor 16, and has: a shaft 24 attached in a direction orthogonal to the rotation shaft center of the upper rotor rotation shaft 19 and in parallel with the shaft center of the rotor driving shaft 18; a stabilizer holder 23 formed in a rectangular ring shape and pivotally attached to the shaft 24; a pair of stabilizer shafts 21, 21 attached to both end surfaces of the stabilizer holder 23 to be orthogonal to a shaft center of the shaft 24; weights 22, 22 attached on end sides of the stabilizer shafts 21, 21; a shaft-like joint 26 attached in parallel with the shaft center of the shaft 24 of the stabilizer holder 23 to project into an end face slightly close to one of the stabilizer shafts 21; and the L-shaped link 25 to link the joint 27 attached to the upper blade holder 49 with the joint 26 attached to the stabilizer holder 23. The stabilizer holder 23 is formed in a rectangular ring shape, and pivotally attached to the shaft 24 projecting to be orthogonal to a surface flatly cut in a side surface on an upper end side of the upper rotor rotation shaft 19. Thus, the stabilizer 20 is configured in such a manner that the stabilizer holder 23 tilts around the shaft 24 when shaft centers of the stabilizer shafts 21, 21 tilt in a certain direction together with the weights 22, 22, with the result that the upper blade holder 49 tilts via the joint 26, the link 25 and the joint 27 and that surfaces of the upper rotor blades 17, 17 tilt in the same direction.

The lower rotor 28 has a rectangular plate-shaped lower blade holder 57 fixed to an outer peripheral portion of a lower rotor rotation shaft 30, and a pair of lower blades 29, 29 attached on both end surface sides of the lower blade holder 57 in a direction orthogonal to a shaft center of the lower rotor rotation shaft 30, wherein rotation of the lower rotor rotation shaft 30 is transmitted to the pair of lower blades 29, 29 via the lower blade holder 49.

An upper side of the upper rotor rotation shaft 19 to which the upper rotor 16 is attached is formed to be a slightly thick shaft, while a lower side thereof is formed to be a thin shaft. The lower rotor rotation shaft 30 is substantially formed into a shape of a pipe, into which pipe the thin shaft on the lower side of the upper rotor rotation shaft 19 is rotatably inserted. The upper rotor rotation shaft 19 and the lower rotor rotation shaft 30 are attached to the head 12 of the flying object 11 so as to penetrate into the same from its top, and rotationally driven in opposite directions from each other by the driver 31.

The driver 31 is disposed inside the head 12, and has an upper frame 32 and a lower frame 33 to support and attach the respective parts; a rotor drive motor 34, a pinion 36 attached to an output shaft 35 of the rotor drive motor 34; an upper rotor driving gear 37 which engages with the pinion 36; a first relay gear 39 which is rotatably attached to a shaft 38 and which engages with the upper rotor driving-gear 37; a second relay gear 41 which is rotatably attached to a shaft 40 and which engages with the first relay gear 39; and a lower rotor driving gear 42 which engages with the second relay gear 41. The upper rotor driving gear 37 is fixed to the lower side of the upper rotor rotation shaft 19 whose lower end portion is axially supported by the lower frame 33. Further, the lower rotor driving gear 42 is formed to have the same number of teeth as that of the upper rotor driving gear 37, disposed on an upper side of the upper rotor driving gear 37, and fixed to a lower side of the lower rotor rotation shaft 30 disposed concentrically with the upper rotor rotation shaft 19. A middle portion of the lower rotor rotation shaft 30 is rotatably supported by the upper frame 32. The first relay gear 39 and the second relay gear 41 have the same number of teeth, have shaft centers in parallel with the upper rotor rotation shaft 19 and the lower rotor rotation shaft 30, and are rotatably attached to the shaft 38 and the shaft 40 whose end portion sides are axially supported by the upper frame 32 and the lower frame 33, respectively. That is, turning force of the rotor drive motor 34 is transmitted to the upper rotor rotation shaft 19 from the output shaft 35 via the pinion 36 and the upper rotor driving gear 37, and also transmitted to the lower rotor rotation shaft 30 from the upper rotor driving gear 37 via the first and second relay gears 39, 41 and the lower rotor driving gear 42. Thus, the upper rotor rotation shaft 19 and the lower rotor rotation shaft 30 are driven by the rotor drive motor 34 at the same rotation number to rotate in opposite directions from each other.

The upper frame 32 and the lower frame 33 are fixed to a frame provided in the head 12. Further, in the flying object 11, there are provided the control circuit 43 having a receiving circuit 46 to receive the signal transmitted from the transmitter via an antenna 45 and a controller 47 to control rotation of the rotor drive motor 34 on the basis of a received signal from the receiving circuit 46, a battery 44 which supplies electric power, and a power switch 48 which turn on/off a power source of the battery 44. The controller 47 increases the rotation number of the rotor drive motor 34 when the signal from the transmitter indicates ascending, decreases the rotation number when the signal indicates descending, or controls the rotation number so that the flying toy floats in the air when the signal indicates hovering.

An operation of the flying toy 10 having the above-mentioned configuration will be described. First, the foot 15 of the flying object 11 is placed on a horizontal place, and the power switch 48 is turned on. Next, when an ascend signal is transmitted from the predetermined transmitter, the signal is received by the receiving circuit 46 from the antenna 45 provided in the flying object 11, and the controller 47 causes power of the battery 44 to be supplied to the rotor drive motor 34 to drive this motor. The turning force of the rotor drive motor 34 is transmitted to the upper rotor rotation shaft 19 from the output shaft 35 via the pinion 36 and the upper rotor driving gear 37, and also transmitted to the lower rotor rotation shaft 30 from the upper rotor driving gear 37 via the first and second relay gears 39, 41 and the lower rotor driving gear 42, thereby driving the upper rotor 16 and the lower rotor 28 at the same rotation number to rotate in the opposite directions from each other. This rotates the upper rotor blades 17, 17 of the upper rotor 16 and the lower blades 29, 29 of the lower rotor 28 so that the flying object 11 starts ascending flight. At this point, since the upper rotor 16 and the lower rotor 28 rotate in the opposite directions from each other, their reaction torques applied to the flying object 11 are offset, and the flying object 11 ascends without rotation of the flying object 11 itself. Further, when a descend signal or a hovering signal is transmitted from the transmitter, the controller 47 controls the rotation number of the rotor drive motor 34 to bring it to a rotation number suitable to each operation. Moreover, the stabilizer 20 attached to the upper rotor rotation shaft 19 rotates together with the upper rotor 16 in the same direction, and when the stabilizer shafts 21, 21 rotate in a horizontal posture, the stabilizer 20 continues a stable operation so as to maintain the horizontal posture, as shown in FIG. 6. As shown in FIG. 7 or 8, when the stabilizer shafts 21, 21 tilt from the horizontal posture for some reason, the surfaces of the upper rotor blades 17, 17 are operated to tilt in the same direction via the link 25, while centrifugal force functions to automatically maintain the surfaces of the upper rotor blades 17, 17 of the upper rotor 16 in a horizontal position. Thus, the posture of the flying object 11 can be maintained to ensure a stable operation.

In the flying toy 10 having the above-mentioned configuration, since the upper rotor 16 and the lower rotor 28 which concentrically rotate in the opposite directions from each other are provided on the top of the flying object 11 which replicates the model such as the doll having the optional character, it is possible to play with the flying toy by causing it to freely ascend/descend or to hover in the air to a certain degree without rotating the flying object 11 itself. Moreover, since the stabilizer 20 which rotates in conjunction with the upper rotor 16 is provided to maintain a stable posture, the flying object 11 can be stably operated while the horizontal posture thereof is maintained.

Figure 10:
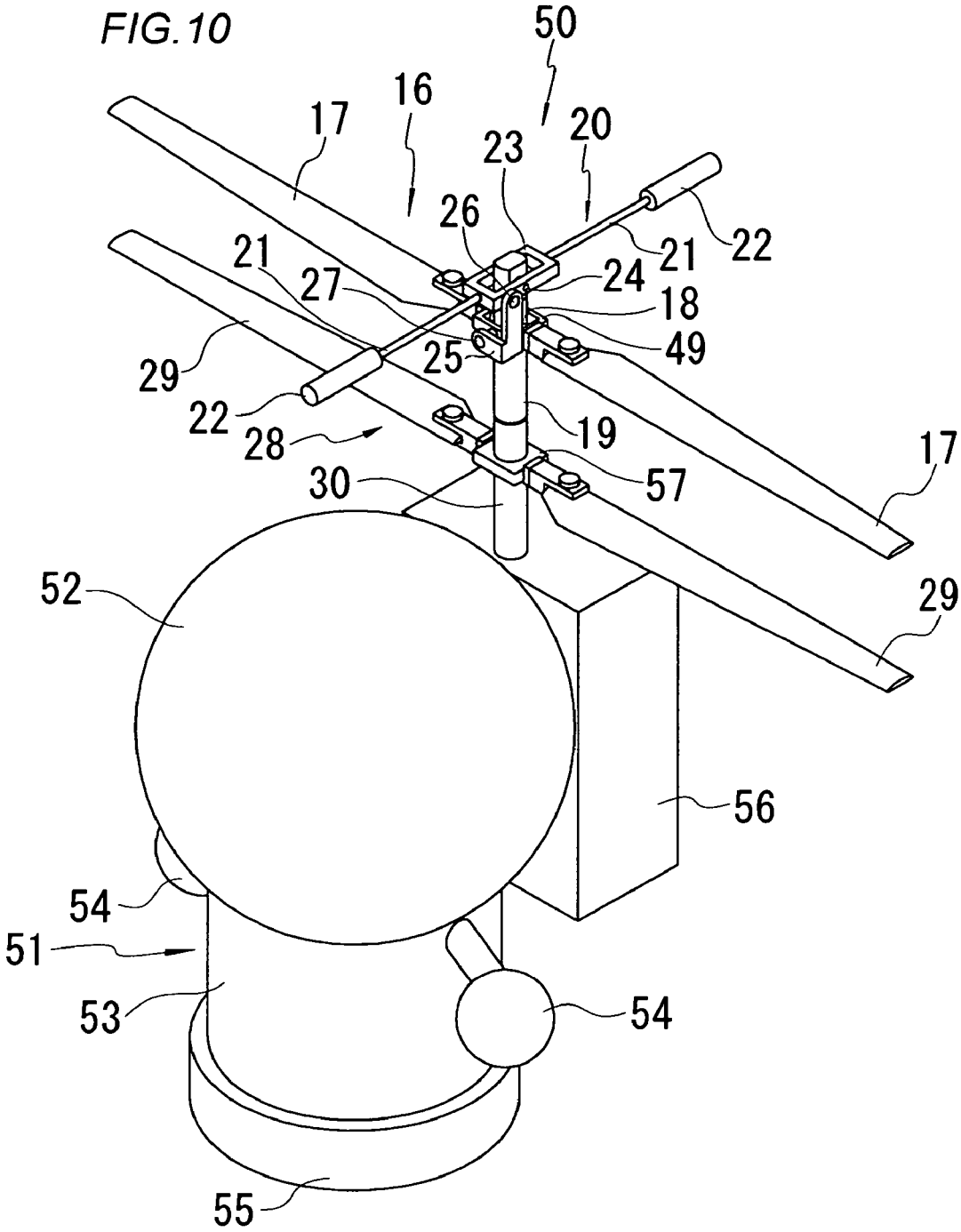
FIG. 10 is a perspective view of the flying toy in a second embodiment of the present invention.

FIG. 10 is a perspective view of the flying toy in a second embodiment of the present invention. It is to be noted that the same numerals are assigned to the parts and members corresponding to those in the first embodiment, and those are not described in detail.

In a flying toy 50 of the second embodiment, a flying object 51 has a circularly formed head 52 on an upper side, a cylindrical body 53 formed on a lower side of the head 52, arms 54, 54 provided on right and left side surfaces of the body 53, a foot 55 provided at the bottom of the body 53, and a rear side part 56 provided on a rear side of the body 53. On an upper side of the rear side part 56, there are provided, as in the first embodiment, an upper rotor 16 and a lower rotor 28 which rotate in directions opposite from each other, and a stabilizer 20. Inside the rear side part 56, a driver 31 is provided. The rest of the configuration are the same as those in the first embodiment.

In the flying toy 50 of the second embodiment, since the upper rotor 16, the lower rotor 28 and the stabilizer 20 are provided on the top of the rear side part 56 of the flying object 51, it is possible to play with the flying toy by causing it to freely ascend/descend or to hover in the air to a certain degree without rotating the flying object 51 itself, and the horizontal posture can be maintained to achieve a stable operation, and moreover, the flying object 51 having a character such as a doll can be caused to look as if it is carrying luggage or the like on its back.

It is to be noted that in the embodiments described above, the flying object 11, 51 may be in any form as long as it is modeled on a character doll having an optional shape or the like, and it is not limited to the shape and the like of the embodiments. Further, the stabilizer 20 may be in any form as long as it rotates in conjunction with at least one of the rotors which rotate opposite from each other.

The present invention can be utilized for a flying object in which a flying toy on a model having an optional character can be caused to freely ascend/descend or hover by remote control.

What is claimed is:

1. A flying toy comprising:

a flying object including a hollow, enclosed, heavier-than-air body having a shape of a character;

an upper rotor mounted on an upper rotation shaft and a lower rotor mounted on a lower rotation shaft, the rotors being provided on the top of the enclosed body and which concentrically rotate in directions opposite from each other;

a stabilizer mounted to the upper rotation shaft which rotates in conjunction with the upper rotor and which stabilizes orientation and motion of the flying object, the stabilizer being coupled to a tiltable joint, the joint being coupled to a second joint via a link;

an electric motor which is provided inside the enclosed body and which rotates the upper rotor, the lower rotor and the stabilizer;

a control circuit provided inside the enclosed body for remote control to control an operation of the motor; and a battery provided inside the enclosed body to serve as a power source for the motor and the control circuit.

2. The flying toy according to claim 1, wherein the stabilizer and the upper rotor are attached so that surfaces of rotor blades of the upper rotor tilt in conjunction with the stabilizer via the link when the stabilizer tilts from a horizontal position.

3. The flying toy according to claim 1, wherein the character is in a shape of a doll figure and the upper rotor and the lower rotor are provided on a head or a rear side part of the flying object.

* * * * *